United States Patent [19]

Claesson et al.

[11] Patent Number: 4,816,632

[45] Date of Patent: Mar. 28, 1989

[54] MULTI-RESONANT MICROWAVE OVEN HAVING AN IMPROVED MICROWAVE DISTRIBUTION

[75] Inventors: Jan S. Claesson, Linköping; Per O. G. Risman, Herryda; Bo A. Wass, Linköping, all of Sweden

[73] Assignee: U.S. Philips Corporation, New York, N.Y.

[21] Appl. No.: 141,352

[22] Filed: Jan. 6, 1988

[30] Foreign Application Priority Data

Jan. 8, 1987 [SE] Sweden ..... 8700046

[51] Int. Cl.[4] ..... H05B 6/74

[52] U.S. Cl. ..... 219/10.55 F; 219/10.55 E

[58] Field of Search ..... 219/10.55 E, 10.55 F, 219/10.55 R, 10.55 A

[56] References Cited

U.S. PATENT DOCUMENTS

| | | | |
|---|---|---|---|
| 3,218,429 | 11/1965 | Lenart | 219/10.55 F |
| 3,461,260 | 8/1969 | Bremer | 219/10.55 F |
| 3,478,187 | 11/1969 | Agour et al. | 219/10.55 F |
| 3,740,514 | 6/1973 | Anderson | 219/10.55 F |
| 3,857,009 | 12/1974 | Mac Master et al. | 219/10.55 E |
| 3,941,968 | 3/1976 | Mac Master et al. | 219/10.55 E |
| 4,019,009 | 4/1977 | Kusunoki et al. | 219/10.55 F |
| 4,121,078 | 10/1978 | Takano et al. | 219/10.55 |
| 4,165,454 | 8/1979 | Carlsson et al. | 219/10.55 F |
| 4,223,194 | 9/1980 | Fitzmayer | 219/10.55 F |

FOREIGN PATENT DOCUMENTS

| | | | |
|---|---|---|---|
| 1515156 | 7/1969 | Fed. Rep. of Germany | 219/10.55 F |

*Primary Examiner*—Philip H. Leung

*Attorney, Agent, or Firm*—Thomas A. Briody; Jack E. Haken; Emmanuel J. Lobato

[57] ABSTRACT

A microwave oven comprises an oven cavity (10) bounded by conductive walls (11–16) and a microwave source (17–19) situated such that microwave energy is fed from above into the oven cavity (10). A bottom plate (20) of a dielectric material is situated above the conductive bottom wall (16), on which plate (20) food to be heated (21) is placed. Two conductive ridges (24, 25) project from the conductive bottom wall (16), which ridges (24, 25) are situated adjacent and in parallel to the respective shorter conductive side walls (12, 14). The dielectric bottom plate (20) is placed and dimensioned such that a trapped TM resonant mode is generated in the space between the upper surface of the bottom plate (20) and the conductive bottom wall (16). This trapped TM resonant mode is excited via the bottom plate (20) and the ridges (24, 25) by the microwave field above the bottom plate (20), microwave energy from the TM resonant mode within and below the bottom plate (20) will "leak" into the food (21) owing to its higher dielectric constant, whereby the food (21) will be subjected to an appreciable heating from below.

8 Claims, 1 Drawing Sheet

MULTI-RESONANT MICROWAVE OVEN HAVING AN IMPROVED MICROWAVE DISTRIBUTION

BACKGROUND OF THE INVENTION

The invention relates to a microwave oven comprising an oven cavity bounded by a plurality of conductive walls, a microwave source mounted external of said oven cavity for feeding microwave energy into the interior of the oven cavity and a bottom plate of insulating material situated above the conductive bottom wall of the oven cavity and adapted to support food to be heated. The feed for the microwave energy is situated above the bottom plate, preferably in the top wall of the oven cavity. The most common manner to excite such an oven is to produce and maintain several simultaneously existing resonant modes in the oven cavity according to the so called multi-resonance principle.

An essential problem in multi-resonant oven cavities with feeding from above is that, in case of extended objects (loads) to be heated which have such a large thickness that microwave fields coming from above are not able to penetrate sufficiently deep, there will not be heating of the central parts of the lower portion of the load. In ovens with microwave feeding from below this problem is solved, but in this case the microwave field passing upwardly from the region beyond the load and then being reflected against the cavity walls will generally be in sufficient to heat the central upper parts of the peripheral parts of the load because of diffraction phenomena determined by the load geometry, the so-called edge heating effect.

Many attempts at solving the above-mentioned problem have been made. A radical solution is to feed the microwaves both from above and from below with the aid of separate waveguide systems. Such a solution will, however, be expensive. Other solutions involve various ways of "receiving" and converting microwave energy by means of special structures or systems in order to improve the heating of the lower part of the load.

Still other methods for improving the heating effect in multi-resonant oven cavities are based upon the idea to locally change the oscillation pattern in the cavity in a controlled manner. Reference may be made to the following prior art documents:

U.S. Pat. No. 3,740,514 describes a method for modifying resonant modes in an oven cavity or for providing additional resonant modes by means of dielectric blocks positioned so as to achieve a more even distribution of the microwave energy throughout the load. However, the dielectric bottom plate supporting the load is not used for this purpose.

U.S. Pat. No. 4,121,078 describes a microwave oven in which at least a part of the output of the microwave source is coupled to a surface waveguide system, substantially of a delay line type, that acts to concentrate microwave energy in a specific region of the oven. The surface waveguide system comprises a periodic structure of a metallic material and the food-supporting bottom plate of low-loss dielectric material does not perform a specific microwave function, i.e. it does not modify the microwave field in dependence on the wavelength.

U.S. Pat. No. 4,019,009 describes several variants of the above techniques. All these variants relate to arrangements comprising both dielectric and metallic elements for providing a structure that is referred to as a surface waveguide, but should be more truly regarded as a leaky delay line structure.

U.S. Pat. No. 3,941,968 describes a microwave browning and searing plate comprising a periodic array of parallel dielectric bar members, each having a coating of conductive material on three sides and an uncoated top side that supports the food. When microwave energy is applied to the plate, the uncoated sides provide an intense fringing field adjacent to the top surface of the plate for browning and searing the outer surfaces of the food. The microwave field existing in a multi-resonant microwave oven cavity provides the microwave energy that is applied to the browning plate. A structurally and functionally similar browning plate is described in U.S. Pat. No. 3,857,009 in which the periodic array comprises parallel strips of alternately higher and lower dielectric constant.

U.S. Pat. No. 4,165,454 describes a more generalized microwave energy feeding system that may act as both a microwave delay line and a resonance structure determining the microwave field in its vicinity. This structure is essentially a wire or strip conductor configuration adjacent to the bottom wall of the microwave oven and the excitation of the oven cavity takes place by directly supplying microwave energy to the structure.

SUMMARY OF THE INVENTION

It is an object of the present invention to provide a microwave oven of the kind described in the preamble and operating according to the multi-resonance principle in a conventional manner, in which the oven cavity is modified so as to achieve an improved energy distribution in the load or food, in particular a better heating of the central lower parts of extended loads, without the use of complicated measures that result in a more expensive oven construction.

According to the invention such a microwave oven is characterized in that the bottom plate of a dielectric material in combination with the conductive bottom wall bounds a substantially plane parallel resonant space having at opposite ends ridges of conductive material projecting from the bottom wall into the resonant space. The thickness of the bottom plate is selected in consideration of the dielectric constant of its material such that a trapped TM resonant mode is generated in said resonant space between the dielectric bottom plate and the conductive bottom wall. The resonant mode is excited via the bottom plate by the microwave field above the bottom plate, and microwave energy from said resonant mode is taken up by the food that is placed on the bottom plate and has a dielectric constant equal to or higher than that of the bottom plate.

The invention is therefore based on the fact that one or more essentially separate resonant modes are excited within and below the bottom plate of dielectric material by the volume resonant field in the oven cavity above the bottom plate and that a part of the energy in the thus excited resonant modes is transferred from below to the load in its central parts. This will result in an improved heating effect, in particular for large extended loads.

Suitably, there are two ridges one at each end of said resonant space between the bottom plate and the bottom wall and furthermore they are suitably, seen from above, substantially rectilinear and parallel with the shorter side walls of the oven cavity and they have a length of substantially n $\lambda/2$, where n is an integer and $\lambda$ is the wavelength in the dielectric medium surrounding the ridges. This will result in a maximally simple cavity construction and in an effective excitation of the resonant modes in and below the bottom plate, via the said ridges, by the microwave field above the bottom plate.

In order to achieve a maximally simple and inexpensive construction, the bottom plate is furthermore given a thickness that is less than the distance from the upper side of the bottom plate to the bottom wall so that, between the bottom plate and the bottom wall, there will be formed a space filled by a medium, preferably air, having a lower dielectric constant than the material of the bottom plate.

However, in order to enable the bottom plate of dielectric material to trap the oscillation modes in and below the plate (without load on the plate) the bottom plate must have a certain minimum thickness which is related to the dielectric constant of the material in the plate. In a preferred embodiment, the dielectric constant $\epsilon_r$ of the bottom plate is therefore at least 4.5 and its thickness is approximately $\lambda/8$, where $\lambda$ is $\lambda_0/\sqrt{\epsilon_4}$ and $\lambda_0$ is the free-space wavelength (practically $\lambda_0$ is the wavelength in air).

Besides the thickness of the bottom plate, which is a critical parameter, also the distance between upper side the bottom plate and the bottom wall is of importance. In a preferred embodiment the said distance is such that the electrical distance between the upper side of the bottom plate and the bottom wall substantially corresponds to $\lambda_0/4$.

In order to produce effective excitation of the resonant space between the bottom plate and the bottom wall via the ridges projecting from the bottom wall, these ridges furthermore shall be situated at a distance substantially equal to $\lambda/2$ from a respective edge of the bottom plate that abuts against a part of the conductive cavity wall.

Preferably, the ridges are integral constituent parts of the cavity bottom wall and they are formed during the manufacture of this wall from a metallic sheet by a simple pressing operation. In a microwave oven operating at 2,450 MHz, the ridges are 7–10 mm high, approximately 10 mm wide and 100–130 mm long and they are situated at a distance of 50–60 mm from the edge of the bottom plate that abuts against a metallic part of the cavity wall.

BRIEF DESCRIPTION OF THE DRAWING

The invention will be more fully appreciated from the following description of an illustrative embodiment with reference to the accompanying drawing, in which.

DETAILED DESCRIPTION OF THE INVENTION

Figure 1:
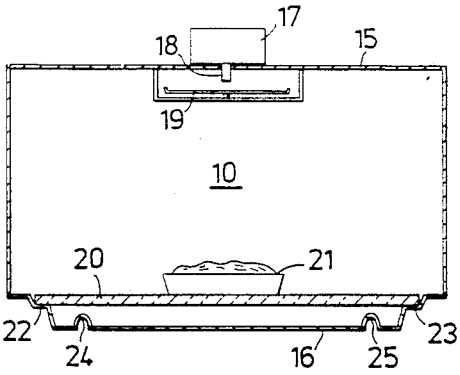
FIG. 1 shows a simplified vertical sectional view of a microwave oven constructed in accordance with the invention.
Figure 2:
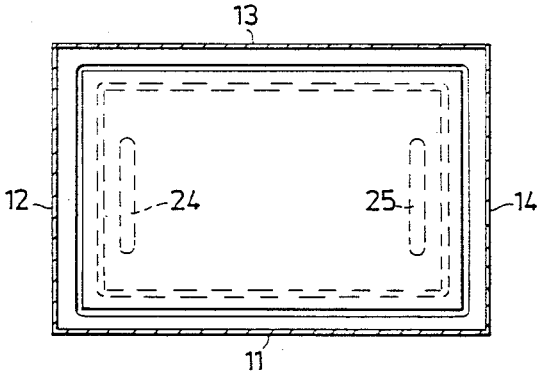
FIG. 2 shows a horizontal sectional view of the same oven.

In FIGS. 1 and 2, reference numeral 10 designates a microwave oven cavity which is bounded by metallic side walls 11–14 and metallic top and bottom walls 15 and 16, respectively. Refernce numeral 17 designates a microwave source in the form of a magnetron with an antenna 18, and reference numeral 19 designates a rotatable field stirrer of metal. Reference numeral 20 designates a bottom plate which serves to support a load 21 consisting of food to be heated. In the embodiment shown, the metallic bottom wall 16 of the cavity is provided with step-shaped shoulders 22 and 23, respectively, at each short side of the cavity and the bottom plate 20 rests against these shoulders 22, 23.

According to the invention, the bottom plate 20 is made of dielectric material, such as ceramics or boron silicate glass, and is placed and dimensioned in consideration of the dielectric constant of its material such that the bottom plate 20 in combination with two ridge-shaped projections 24 and 25 of the metallic bottom wall 16, which ridges 24, 25 extend in parallel with the shorter side walls 12 and 14 of the cavity 10, is able to provide and maintain a trapped TM resonant mode in the space between the bottom wall 16 and the bottom plate 20 and in the bottom plate 20 itself. The projections or ridges 24 and 25, which suitably are integral parts of the metallic bottom wall 16 and are manufactured by a pressing operation, then serve to couple energy from the microwave field above the bottom plate 20 to the resonant space between the bottom plate 20 and the bottom wall 16, while the bottom plate 20 itself serves to trap the oscillating energy, generating a so called trapped resonant mode. If a load in the form of food 21 is placed upon the bottom plate 20, energy will "leak" through the plate into the food as a result of the higher dielectric constant of the food, so that the food is subjected to an appreciable heating from below.

The mode of operation of the invention can be explained in the following manner.

Figure 3:
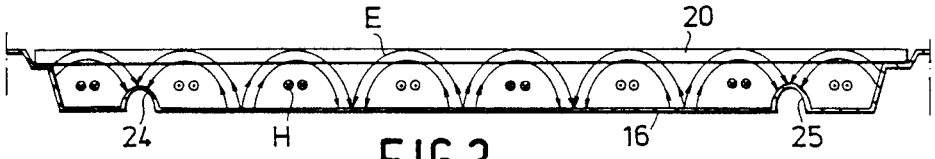
FIG. 3 illustrates the field pattern in the bottom resonant space of the oven according to FIGS. 1 and 2.

Waves propagating downward in different directions towards a ridge or projection 24 will be spread in different directions by the ridge. Certain ones of the latter directions then will fulfil the conditions for the establishment of the microwave field pattern as illustrated in FIG. 3. One of the conditions is of course that the zone above the ridge or projection 24 is free and not covered by the load to be heated. The ridge or projection 24 shall therefore be placed in the position that both lies as close to the vertical cavity wall 12 as possible and at the same time fulfils the said bottom resonance conditions. One ridge or projection near each shorter side wall is sufficient.

The bottom resonance is of the TM-type, i.e. the H-field is parallel with the cavity bottom, see FIG. 3. In order to maintain the wave-type it is required that the oscillating energy in the form of a standing wave pattern is essentially larger than the quantity of energy that leaks away during an oscillation period. The wave must therefore have a loose coupling to the surroundings. In order to achieve this the dimensioning of the bottom plate (inclusive of its dielectric constant and its thickness) and the space below the bottom plate must be such that the conditions for a "trapped mode" are fulfilled, i.e. substantially total reflection of the microwve field at the upper boundary surface of the bottom plate. The most simple type of such a wave pattern is shown in FIG. 3, where the lines E represent the electric field and the lines H represent the magnetic field. This wave-type is characterized in that the electrical distance between the cavity bottom wall and the upper boundary surface of the bottom plate substantially corresponds to a quarter wavelength and that certain conditions are fulfilled as regards the dielectric constant and the thickness of the plate.

If the bottom plate is too thin, it will interact poorly, i.e. it does not trap the mode. The same applies if the bottom plate has too low a dielectric constant. If this constant is too high, the transparency for the excitation will be too poor and besides, purely practical problems, such as energy absorption and costs, will aggravate because it will be more difficult to find suitable material. Examples of suitable data for microwave ovens operating at 2,450 MHz are: a dielectric constant of 6 to 7, a thickness of 5 to 7 mm and a distance from lower boundary to cavity bottom of 12 to 14 mm. These data will result in a thickness, corresponding to an electrical length of approximately $\lambda_0/4$, where $\lambda_0$ is the free-space wavelength.

Energy absorption in the object to be heated (the load) implies that energy can leak away upwardly from the "trapped mode". This becomes possible in that the dielectric constant of the material in the normally used cooking vessels is comparable to that of the material in the bottom plate and that the dielectric constant normally is even higher for the food itself. Total reflection will therefore not take place in those regions where the load is placed, but the energy from the resonant mode can leak away there. In the case that the load or the vessel is not situated close to the upper surface of the bottom plate, but is situated more than a few millimeters above this surface, the coupling between the bottom resonant space and the load may be weaker. However, the impairment of the coupling will normally be small, because a "capacitive transmission" of energy will take place.

Besides the mentioned parameters: the dielectric constant of the bottom plate 20, its thickness and its height above the cavity bottom, also the dimensioning and position of the ridges 24, 25 are of importance. In order to ensure an effective excitation of the space between the bottom plate and the cavity bottom via the ridges in the bottom wall, these ridges shall also have a length amounting to an integer number of half wavelengths of the exciting microwave energy and a distance from the edge of the bottom plate approximately equal to a half wavelength. The mutual distance between the ridges amounts suitably to about an even number of half wavelengths, corrected for the somewhat shorter standing wavelength taking account of the dielectric constant of the plate.

In a modified embodiment, the bottom plate extends down to the metallic cavity bottom wall. However, the microwave technical gain with this construction, which involves a more complicated and expensive plate construction is small because most of the energy still will be stored where the E-field is large, i.e. in the upper part of the plate. A suitable compromise is therefore to let the plate cover approximately $\frac{1}{8}$ wavelengths and to have an equally large air-space, in the electrical sense, between the plate and the cavity bottom wall.

What is claimed is:

1. A microwave oven comprising an oven cavity bounded by a plurality of conductive walls, a microwave source mounted external to said oven cavity for feeding microwave energy into the interior of the oven cavity and a bottom plate of insulating material situated above a conductive bottom wall of the oven cavity and adapted to support food to be heated, a feed for the microwave energy being situated above the bottom plate, characterized in that the bottom plate of a dielectric material in combination with the conductive bottom wall bounds a substantially plane parallel resonant space having at opposite ends ridges of conductive material projecting from the bottom wall into the resonant space, the bottom plate having a thickness and a dielectric constant such that a trapped TM resonant mode is generated in said resonant space between the dielectric bottom plate and the conductivde bottom wall, said resonant mode being excited via the bottom plate by the microwave field above the bottom plate and the microwave energy from said resonant mode being taken up by food that is placed on the bottom plate and has a dielectric constant equal to or higher than that of the bottom plate.

2. A microwave oven as claimed in claim 1, wherein said conductive walls comprise a pair of shorter side walls and a pair of longer side walls, characterized in that two ridges, one at each end of said resonant space, are arranged so that in plan they are substantially rectilinear and parallel with the shorter side walls of the oven cavity and have a length of substantially $n\lambda/2$, where n is an integer and $\lambda$ is the wavelength in a dielectric medium surrounding the ridges.

3. A microwave oven as claimed in claims 1 or 2, characterized in that the bottom plate has a thickness smaller than the distance from the upper side of the bottom plate to the bottom wall of the oven cavity, so that, between the bottom plate and the bottom wall, a space is formed that is filled by a dielectric medium, having a lower dielectric constant than that of the bottom plate.

4. A microwave oven as claimed in claim 3, characterized in that the dielectric constant $o_r$ of the bottom plate is at least 4.5 and its thickness approximately $\lambda/8$, where $\lambda$ is $\lambda_0/\sqrt{\epsilon_r}$ and $\lambda_0$ is the free-space wavelength.

5. A microwave oven as claimed in claim 1 or 2, characterized in that the distance between the bottom plate and the bottom wall of the oven cavity is such that the electrical distance between the bottom wall and the upper surface of the bottom plate substantially corresponds to $\lambda_0/4$, where $\lambda_0$ is the free-space wavelength.

6. A microwave oven as claimed in claim 1 or 2, characterized in that the ridges are situated at a distance of substantially $\lambda/2$ from a respective edge of the bottom plate that abuts against a metallic part of the conductive cavity wall, where $\lambda$ is the wavelength in a dielectric medium surrounding the ridges.

7. A microwave oven as claimed in claim 1 or 2, and arranged for operation at 2,450 MHz, characterized in that the bottom wall comprises two ridges arranged in parallel with the shorter side walls and surrounded by a medium having a dielectric constant substantially equal to unity, the ridges being 7 to 10 mm high, approximately 10 mm wide and 100 to 130 mm long, and being furthermore situated at a distance of 50 to 60 mm from the respective edges of the bottom plate that abuts against metallic parts of the oven cavity walls.

8. A microwave oven as claimed in claim 1 or 2, characterized in that the bottom wall has been formed integrally from a metallic sheet, the ridges being integral constituent parts of the bottom wall that have been formed by a pressing operation on said metallic sheet.

* * * * *